US010247409B2

(12) United States Patent
Zhang et al.

(10) Patent No.: US 10,247,409 B2
(45) Date of Patent: Apr. 2, 2019

(54) REMOTE PREHEAT AND PAD STEAM GENERATION

(71) Applicant: CONOCOPHILLIPS COMPANY, Houston, TX (US)

(72) Inventors: Jingwei Zhang, Sugar Land, TX (US); Scott Macadam, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 363 days.

(21) Appl. No.: 15/341,076

(22) Filed: Nov. 2, 2016

(65) Prior Publication Data

US 2017/0122552 A1 May 4, 2017

Related U.S. Application Data

(60) Provisional application No. 62/250,872, filed on Nov. 4, 2015.

(51) Int. Cl.
*E21B 43/24* (2006.01)
*F22D 1/00* (2006.01)
*F22D 11/02* (2006.01)

(52) U.S. Cl.
CPC ..... *F22D 1/003* (2013.01); *E21B 43/2406* (2013.01); *F22D 11/02* (2013.01)

(58) Field of Classification Search
CPC ..... E21B 43/2406
See application file for complete search history.

(56) References Cited

U.S. PATENT DOCUMENTS 8,973,658 B2 3/2015 Macadam
2015/0021031 A1 1/2015 Macadam

*Primary Examiner* — Robert E Fuller
(74) *Attorney, Agent, or Firm* — ConocoPhillips Company

(57) ABSTRACT

Methods and systems generate steam for injection in a well to facilitate oil recovery. Water is preheated at a central processing facility, transported to a well pad by hot water lines, and converted to steam by a steam generator at the well pad.

18 Claims, 5 Drawing Sheets

REMOTE PREHEAT AND PAD STEAM GENERATION

PRIOR RELATED APPLICATIONS

This application is a non-provisional application which claims benefit under 35 USC § 119(e) to U.S. Provisional Application Ser. No. 62/250,872 filed Nov. 4, 2015, entitled "REMOTE PREHEAT AND PAD STEAM GENERATION," which is incorporated herein in its entirety.

FIELD OF THE DISCLOSURE

The invention relates to methods and systems for generating steam for downhole use.

BACKGROUND

Steam Assisted Gravity Drainage or "SAGD" (pronounced sag-DEE) is an enhanced oil recovery technology for producing heavy crude oil and bitumen. It is an advanced form of steam stimulation in which a pair of horizontal wells are drilled into the oil reservoir, one a few meters above the other. High-pressure steam is continuously injected into the upper wellbore to heat the oil and reduce its viscosity, causing the heated oil and any condensed water to gravity drain into the lower wellbore, where it can be pumped to the surface.

Generally speaking, high quality, high temperature, and high pressure steam is required. The SAGD process may call for 100% quality, 7,000-11,000 kPA and 238-296° C. temperature steam. Considering oil production volume, and the fact that at least 3 barrels of water are needed for every barrel of oil, the water requirements for SAGD are immense, although water recycling can reduce water consumption considerably.

In addition to requiring large amounts of water, the cost of steam generation is a major contributor to the cost of oil production. The fuel needed to heat water to steam and the transportation of high quality steam to the well pad all contribute to high costs. In addition to the cost of steam generation, each barrel of oil produced in SAGD is co-produced with 3-5 barrels of water, which then must be separated from the oil, and treated before recycling. Water treatment facilities further contribute to cost.

Steam can be produced in various ways, including conventional drum boilers, direct steam generators, and once through steam generators. If the water is sufficiently cleaned, e.g., with evaporator technology, a drum boiler can be used, where the water runs through the boiler more than once, and steam is collected at the top in a drum for distribution, while condensate travels back through the boiler for reheating.

However, the "once-through steam generator" or "OTSG" is more commonly used to provide the steam for SAGD, and other steam based enhanced recovery methods such as cyclic steam generation or "CSS," because recycled water typically is not clean enough for conventional boiler use.

The OTSG features a single pass of water through the generator coil, where the feedwater is heated and eventually vaporized by a countercurrent of e.g., hot gas produced by the furnace. Regardless of what boiler technology is used, usually the boiler feedwater is preheated by heat exchange with e.g., a hot combustion gas, usually flue gas, or a hot fluid, such as the hot produced fluids. The recapture of otherwise waste heat reduces the overall energy needed to make steam.

The preheated feedwater is then converted to steam in the OTSG by the heat radiated from the furnace, resulting in about 80% quality steam, i.e. the weight ratio of water to steam at the outlet of the generator is about 1:4. The 80% quality steam then goes through a series of liquid-steam separators (also called "flash drums") to increase the steam quality of OTSG.

Although it is possible to further heat (superheat) the low quality steam to generate 100% steam, this increases fouling of the OTSG as all of the water evaporates and leaves significant solids behind to foul the heat transfer surfaces. Thus, the relatively low steam quality helps to maintain wet conditions in the OTSG tubes in order to reduce fouling and scaling.

The water remaining once the low quality steam and water are separated is called "blow-down" water and has fairly high levels of dissolved organic compounds. Typical blow-down levels are about 20%. Blowdown can be reused in the OTSG, thus saving on overall water usage, but clean boiler feedwater is preferred, because the organics contribute to fouling of the boiler. Thus, blowdown water must be treated before reuse.

There are OTSG designs that include a preheat section, typically called an "ecomomizer", a vaporizer or "radiant" section, and a "superheater" section so that a high quality steam can be generated within a single OTSG unit. However, these units are quite large, expensive, and as noted, superheating steam leads to fouling unless very clean feedwater is used, which is not usually practical given the imperative to reuse water.

Typically, the OTSG is located at the central processing facility (CPF) and the steam is transported to the well pad for injection because the boiler and preheat equipment is too large to be placed at the well pad. However, the steam-lines that connect the CPF boilers to the pads are costly and limited in length due to pressure loss and steam condensation issues. This contributes further to cost.

Therefore, there is the need for an improved steam generation methods that reduce the cost of steam production, e.g., by eliminating the need for steam-lines, but without overcrowding the well pad.

SUMMARY

The present disclosure provides a method of reducing the need for steam lines, but without overcrowding the well pad.

The basis of the disclosure is a process that reduces the thermal duty and, consequently, the size and footprint of well pad boilers. This is accomplished by preheating the well pad boiler feed water to as high a temperature as possible without any vaporization at the CPF and transporting the preheated water to the well pads. Because the feedwater arrives at the well pad at a higher temperature, less energy is needed to convert that feedwater into steam. This reduces the required heat transfer surface area within the boiler and consequently reduces the size and footprint of that boiler. It also reduces the fuel gas and combustion air demand, minimizing utility requirements at the well pads.

Any steam generator technology can be used at the well pad, including water tube drum boilers, fire tube drum boilers, direct steam generators, oxy-fired direct steam generators, OTSG units, and the like. However, the smaller footprint is desired, and thus a single water tube drum boiler may be preferred. Drum boilers also offer the advantage of less blow down, thus reducing the flow rate of blow down that needs to be transferred from the pads to the CPF. Evaporative water treatment is relatively costly, but can be offset by the lower drum boiler versus OTSG boiler costs. However, any steam generator can be used.

The preheated water would ideally be heated to a temperature within 5-30° C., preferably 10-25° C. of the boiling point at the well pad boiler operating steam pressure. Subcool is desired to minimize the likelihood of flashing in the lines. A preferred subcool is 10-20° C. or about 10° C.

SAGD surface facilities include water-preheating capabilities, and in most cases, preheat OTSG feedwater with heat from produced fluids, OTSG blow-down, warm glycol, and other hot streams. However, these heat recovery systems only enable preheat temperatures of 140-180° C. If supplemental preheating is required, it will need to be provided by a fired heater, boiler, or other high temperature heat source. Several embodiments are described herein.

The first embodiment applies to processes that include boilers both at the CPF and at the well pads. In these applications, the CPF boilers provide the necessary preheating. Two options are shown in FIG. 2 and may be employed in combination as illustrated or separate. Firstly, the well pad boiler feed-water is heated in a coil within an OTSG economizer section, where the OTSG is located at the CPF. This uses some of the thermal duty of the OTSG to provide feed water preheating, but requires a customized OTSG that can generate steam from one water source and preheat water from a second water source.

In the second option, the well pad boiler feed-water is heated by heat exchange with the hot OTSG blow-down. This enables the use of existing OTSGs, but will impact the OTSG heat recovery system because blow-down heat that would otherwise preheat OTSG feed-water is now used to heat pad boiler feedwater.

A possible limitation of this embodiment is that it requires some steam generation at the CPF, which implies that the preheat temperature may be limited by the ratio of well pad to CPF steam generators. This can be addressed by preheating the feed water in a dedicated fired heater placed at the CPF, as shown in FIG. 3. As shown, the fired heater provides supplemental heating of the feedwater after it is initially heated with waste heat (glycol and produced fluids) at the CPF. This is a more flexible configuration, as it does not require steam generation at the CPF.

An alternate heat source to a fired heater is a gas turbine that generates on-site power, as shown in the embodiment of FIG. 4. Gas turbines produced exhaust gas at temperatures of 350-550° C. This heat is often recovered in heat recovery steam generators (HRSGs), but in this embodiment, could provide supplemental water preheat.

The invention includes any one or more of the following embodiments, in any combination thereof:

A method of generating steam for use in a well to produce oil comprising heating a boiler feedwater located at a central processing facility (CPF) to produce heated boiler feedwater (HBFW), transporting the HBFW, which has a subcool of 5-30° C. or 10-20° C., to a well pad via hot water lines, feeding the HBFW into a well pad boiler located at the well pad, and converting the HBFW to steam in the well pad boiler. The steam is then injected into a well located at said well pad to produce oil.

The initial heating at the CPF can be performed by a gas burning water heater, a gas burning turbine heater that produces electricity and HBFW, a once through gas generator (OTSG), or combinations thereof. The well pad boiler can be a water tube drum boiler.

The initial heating at the CPF can also be preceded by a preheating step that preheats the boiler feedwater before it is feed into the heater at the CPF. The HBFW can also be preheated before being heated by the well pad boiler. In some embodiments, both preheating steps occur.

A steam generator system for oil production having a water heater located at a CPF to heat boiler feedwater to HBFW, where the HBFW has a subcool of 5-30° C., a hot water line for transporting the HBFW from the CPF to a steam generator at a well pad, and a steam line for injecting steam into a well at the well pad. The heaters and lines are all fluidly connected.

The steam generator system can have a heat exchanger located at the CPF for preheating said boiler feedwater. The steam generator system can have a heat exchanger located at the well pad for preheating said HBFW. Alternatively, a heat exchanger can be located at both the CPF and well pad for preheating the boiler feedwater and HBFW, respectively.

The steam generator at the well pad can be a water tube drum boiler. The water heater at the CPF can be a gas fired water heater, natural gas fired water heater, a gas burning turbine heater that produces electricity and HBFW, a once through gas generator (OTSG), or combinations thereof An improved method of producing steam for oil production, the method including heating boiler feedwater in a steam generator at a CPF, and transporting the steam in a steam line to a well pad for downhole use, the improvement being heating boiler feedwater in a water heater located at a CPF to 5-30° subcool, transporting the heater boiler feedwater at 5-30° C. subcool to a steam generator located at a well pad, and further heating the heated boiler feedwater in the steam generator to produce steam for downhole use.

An improved method of producing steam for oil production, the method including heating boiler feedwater in a steam generator at a CPF, and transporting the steam in a steam line to a well pad for downhole use, the improvement comprising heating boiler feedwater in a water heater located at a CPF to 10-20° C. subcool, transporting the boiler feedwater at 10-20° C. subcool to a water tube drum steam generator located at a well pad, and heating the boiler feedwater in the water tube drum steam generator to produce steam for injection into a well located at said well pad.

An improved method of producing steam for oil production, the method includes heating boiler feedwater in a steam generator at a CPF, and transporting the steam in a steam line to a first well pad for downhole use, the improvement comprising heating boiler feedwater in a water heater located at a CPF to 10-20° C. subcool, transporting the boiler feedwater at 10-20° C. subcool to a second well pad, preheating the 10-20° C. subcooled boiler feedwater in a heat exchanger located at the second well pad, converting the preheated boiler feedwater to steam in a water tube drum boiler located at the second well pad, and injecting the steam into a well located at the second well pad.

As used herein, a "water tube drum boiler" is a drum based steam generator having 1-4 drums, which function to collect the steam generated in the water tubes and acts as a phase-separator for the steam/water mixture. Water is routed back through the boiler. See e.g. FIG. 1A. A "fire tube drum boiler" has the hot gas in the tube, instead of the liquid, but this older technology is less commonly used today.

As used herein, a "Once-Through Steam Generator" or "OTSG" is a specialized type of heat recovery steam generator without boiler drums. See e.g. FIG. 1B. In this design, the inlet feedwater follows a continuous path. The absence of drums allows for quick changes in steam production and fewer variables to control, and is ideal for cycling and base load operation.

The OTSG without a superheating section typically produces a "wet" steam that consists of about 77% steam and 23% water. The water that is separated from the steam is known as "blowdown water." It typically has concentrated levels of TOC and thus is quite dirty.

As used herein, "economizer" means the device for reducing energy consumption in a steam-generating operation by preheating feedwater. Typically, an economizer is in the form of heat exchanger where the thermal energy is transferred from a high temperature fluid (e.g., steam condensate, flue gas or other waste heat source) to the feedwater such that less energy is required to vaporize it. Economizers are mechanical devices intended to reduce energy consumption or to perform another useful function such as preheating a fluid. In boilers, economizers are heat exchange devices that heat fluids, usually water, up to but not normally beyond the boiling point of that fluid. Economizers are so named because they can make use of the enthalpy in fluid streams that are hot, but not hot enough to be used in a boiler, thereby recovering more useful enthalpy and improving the boiler's efficiency. They are fitted to a boiler and save energy by using e.g., the exhaust gases from the boiler or other hot plant fluids to preheat the cold feedwater. It has been reported that approximately 35 to 50% of the total absorbed heat in OTSG is transferred in the economizer.

As used herein, "radiant section" means the section in a steam generator where the heating of feedwater is primarily achieved by radiant heat transfer.

As used herein, "subcooling" is any temperature of a liquid or solid below its saturation temperature. Saturation is simply the term used to describe the point where a change of state in a substance is taking place. For water at sea level, the boiling temperature is 212° F. or 100° C. Therefore, the saturation temperature is 212° F. or 100° C. A subcool of 10° C. or 20° C. will protect the lines from steam flashing if the pressure is reduced.

"Flash steam" is the name given to the steam formed from hot condensate when the pressure is reduced. The transport of subcooled water will prevent steam flashing, and thus the erosion and damage that can occur on flashing.

As used herein, a "hot water line" is rated for hot water use, but not for steam use. Steam lines are typically subject to much stricter requirements due to the high-pressure steam they carry. They are thus more costly.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| ATM | Atmosphere |
| BFW | Boiler feed-water |
| CAPEX | Capital expenditures |
| CCS | Cyclic steam stimulation |
| CPF | Central processing facility |
| DOC | Dissolved organic carbon |
| DSG | Direct steam generator (aka DCSG for direct contact steam generator) |
| NG | Natural gas |
| OPEX | Operating expenditures |
| OTSG | Once-through steam generator |
| SAGD | Steam-assisted gravity drainage |
| TDS | Total dissolved solids |
| TOC | Total organic carbon |
| Ts | Saturation temperature |
| TSS | Total suspended solids |
| WLS | Warm-lime softener |

DETAILED DESCRIPTION

We investigated various alternatives for reducing the cost of steam generation without overcrowding the well pad, and herein describe a method wherein water is heated at the CPF to within 5-30° C. or 10-20° C. of the boiling point at the operating pressure of the OTSG or other steam generator.

The subcooled water is transported to the well pad, where it is converted to steam in an OTSG, water tube drum boiler, or other boiler. If desired, the OTSG can be equipped with an economizer to capture waste heat from the blow-down water, produced fluids or waste flue gas. Because the feedwater is significantly preheated before transport to the OTSG, less fuel is used to create the steam. Further, the lines need only be qualified for hot fluid transport, not steam transport and thus need not meet the elevated temperature tensile tests and other high standards required for high pressure steam lines. In some embodiments, a distance of at least 100 meter or at least 1 kilometer separates the CPF from the well pad with the steam generator.

Figure 1A:
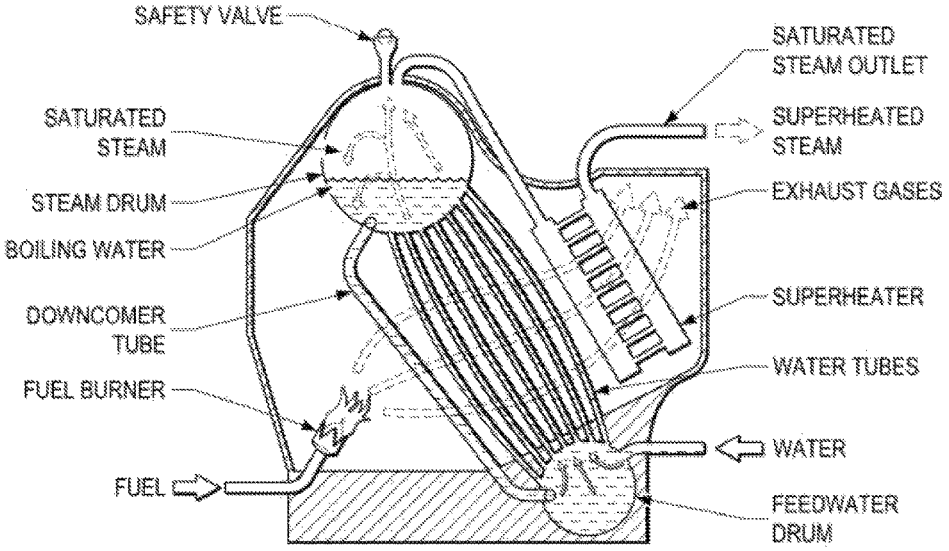
FIG. 1A. provides one example of a water tube drum boiler.
Figure 1B:
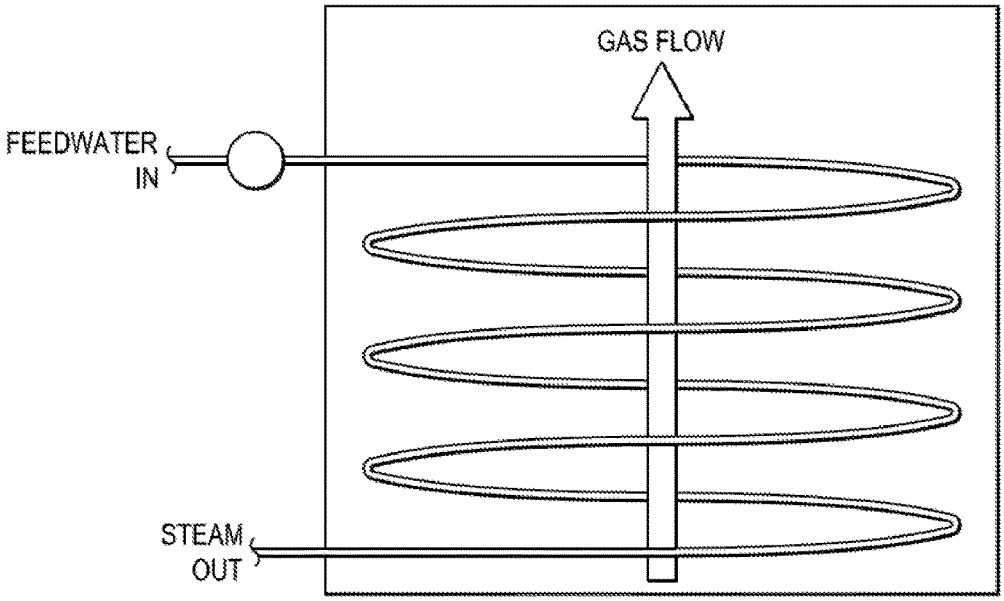
FIG. 1B. illustrates the operating principle for an OTSG.
Figure 2:
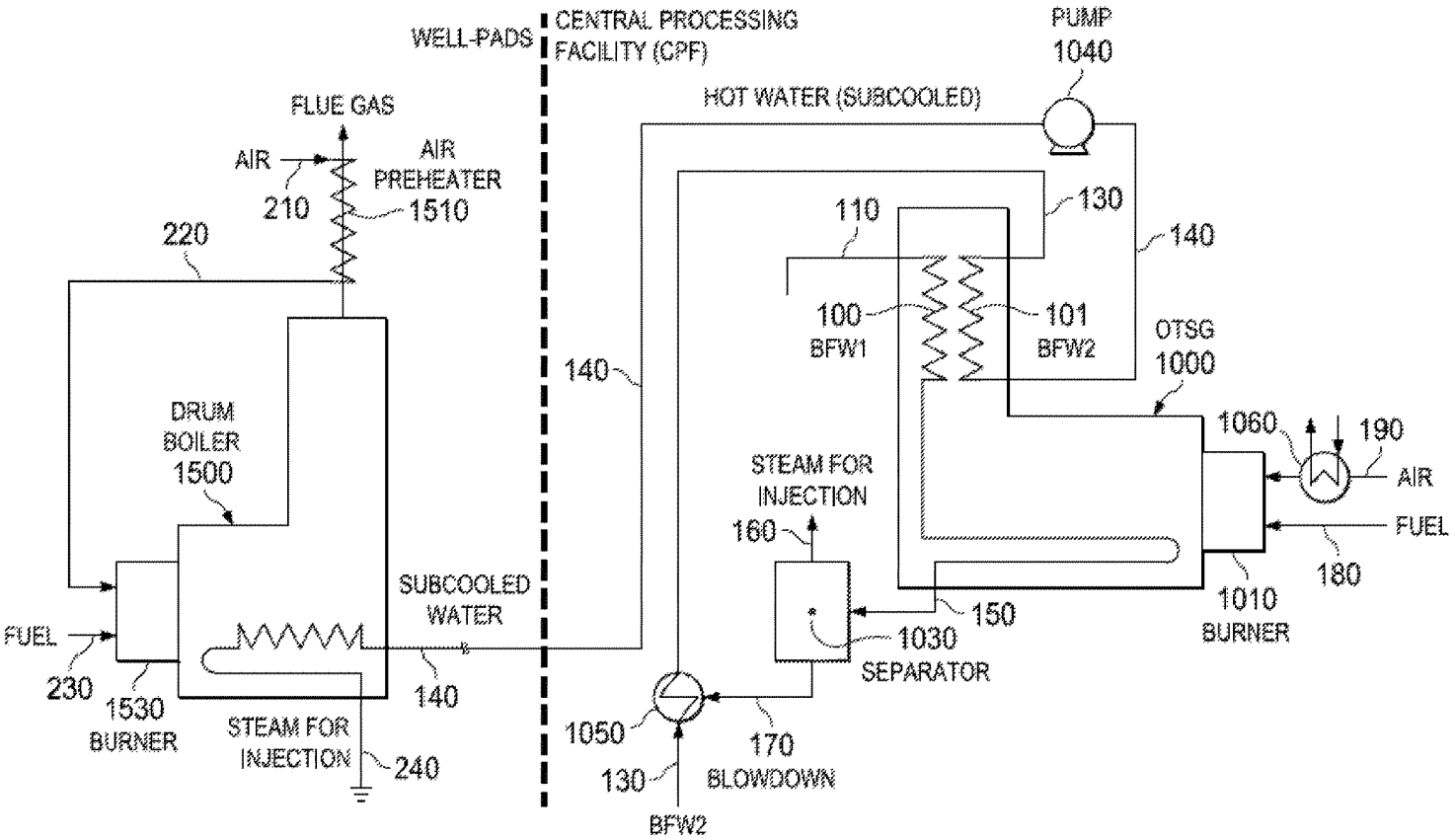
FIG. 2. One embodiment of the disclosed method using preheated well pad steam generator concept, with heat provided by steam generators at CPF.

FIG. 2 shows one embodiment of the disclosure wherein OTSG 1000 is at the CPF and functions (in part) to preheat water for a drum boiler 1500 at the well-pad. Two options are thus shown in FIG. 2. First, where the pad boiler feedwater is heated in a coil within an OTSG economizer section. This uses some of the thermal duty of the OTSG to provide feed water preheating, but requires a customized OTSG that can generate steam from one water source and preheat water from a second water source. In the second option, the well pad boiler feedwater is heated by heat exchange with the hot OTSG blowdown. This enables the use of existing OTSGs, but will impact the OTSG heat recovery system because blowdown heat that otherwise preheats OTSG feedwater is now used to heat pad boiler feedwater. One or the other or even both systems could be used.

In more detail, air entering the OTSG via line 190 is preheated in heat exchanger 1060. Fuel enters the burner 1010 via line 180, mixes with preheated air from line 190 and burns to create hot gas, which travels to the other end of the OTSG heating fluid in coils 100 and 101. The hot gas pathway is from the burners to the stack. Coil 101 accepts boiler feedwater via line 130, which is preheated with blowdown water and coil 100 accepts boiler feedwater via line 110. The routing of these lines is of course variable, as noted above, depending on which option(s) is/are implemented. Hot gas that has given its latent heat to the fluid in the coils 100, 101 can be routed back to heat exchanger 1060 if desired. Alternatively, it can be routed to the stack.

Hot fluid exiting OTSG coils is routed to separator 1030 via line 150, where steam is separated from blow-down water. Steam is routed via line 160 to where its is needed, e.g., to the well pad for injection, and blowdown water run through line 170 to heat exchanger 1050 to warm incoming boiler feedwater via line 130. Preheated water can be routed via line 140 and pump 1040 to the well pad for use in drum boiler 1500.

Subcooled water enters the drum boiler 1500 at the well pad via line 140, is turned into steam in drum boiler 1500 and the steam routed to the well via steam line 240. Fuel enters a burner 1530 of drum boiler 1500 via fuel line 230, and heated air via line 220. The air from line 210 was preheated in air preheater (heat exchanger) 1510 using the exiting flue gas.

Figure 3:
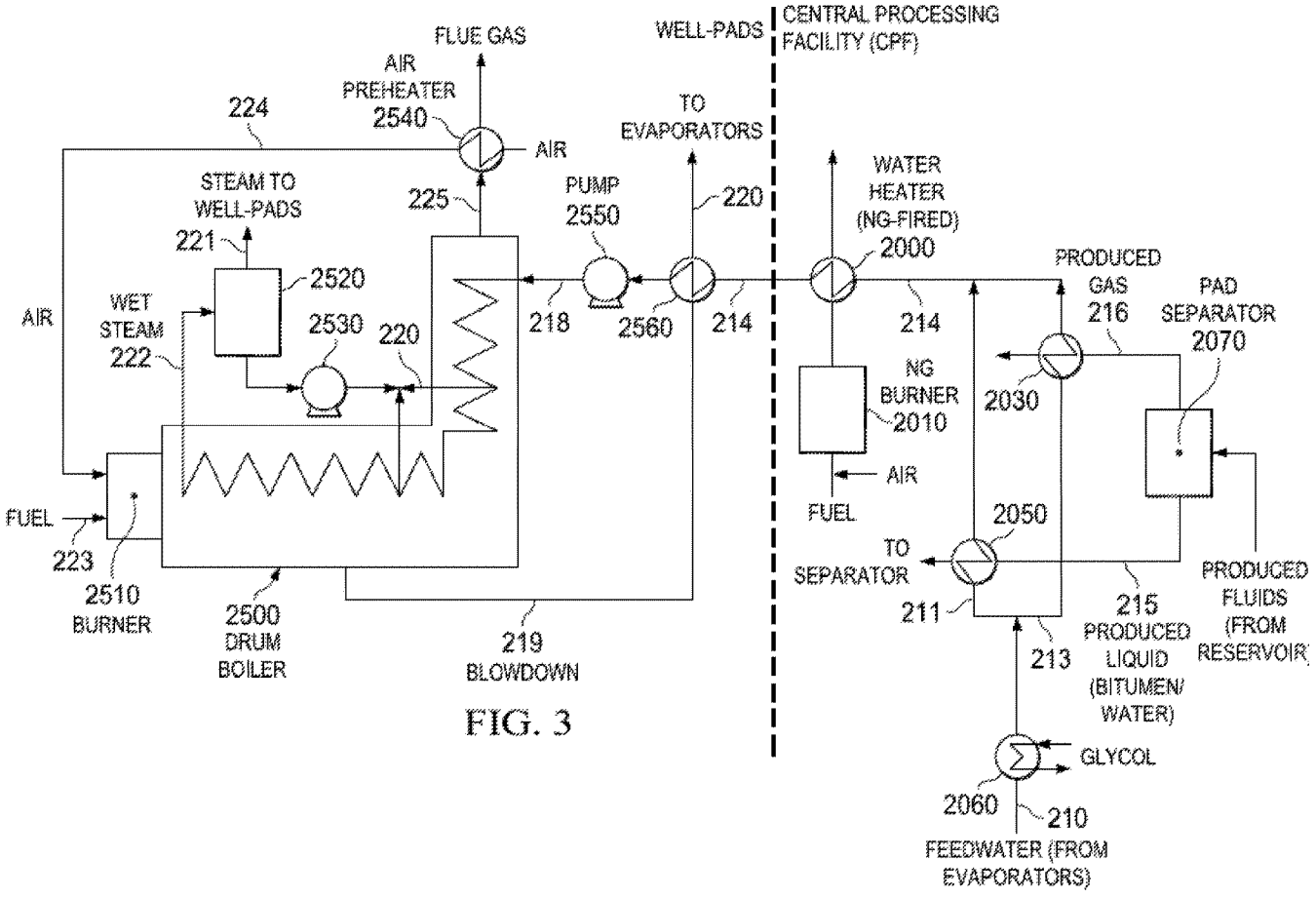
FIG. 3. Another embodiment of the disclosed method using preheated well pad steam generator concept, with heat provided by fired heater at CPF.

FIG. 3 shows yet another embodiment, using a natural gas (NG) fired water heater 2000 at the CPF to preheat water for the steam generator at the well pad, in this case water tube drum boiler 2500. If desired, clean water (e.g., from an evaporator) via line 210 can be preheated with heat exchanger 2060, e.g, by hot glycol originating from e.g., the CPF hot glycol system (i.e. glycol that has been heated in various units that cool process streams). The water can be further heated using produced fluids from the reservoir after separation in a pad separator 2070, using gas heat exchanger 2030 via line 216 for a first portion 213 of the water and liquid heat exchanger 2050 via line 215 for a second portion 211 of the water.

The somewhat cooled produced liquid is then routed to a separator (not shown) for separation into crude oil, routed to storage or shipment, and produced water, which is routed to water treatment facilities, in this instance suggesting an evaporator, but possibly including one or more of filtration, precipitation, warm lime softener, an advanced oxidation process, and the like.

Prewarmed water is routed via line 214 to a water heater 2000, e.g, a NG fired water heater with burner 2010 fed by air and fuel lines. Hot water is transported to the well pad by pump 2550. If desired that water was can also be heated in heat exchanger 2560 by blowdown water fed by line 219. Blowdown water then travels by line 220 to some water treatment facility.

Preheated water enters drum boiler 2500 via line 218. Drum boiler 2500 is heated by burner 2510 fed by air line 224 and fuel line 223. Air line 224 can be preheated in air preheater 2540, which is heated with hot flue gas exiting the drum boiler 2500 via line 225.

Steam exits the drum boiler 2500 via lines 220 and 222 to separator 2520 which sends water back to the drum boiler 2500 via line 220 and pump 2530 and steam to the well via line 221. The steam in lines 220 appears to be running in two directions due to the internal recirculation in water tube drum boilers. Drum boilers inherently have high internal recirculation rates, i.e. only 10-20% of the feedwater is evaporated in boiler. The 10-20% quality steam enters a drum to separate steam/water, and the water is recirculated.

Figure 4:
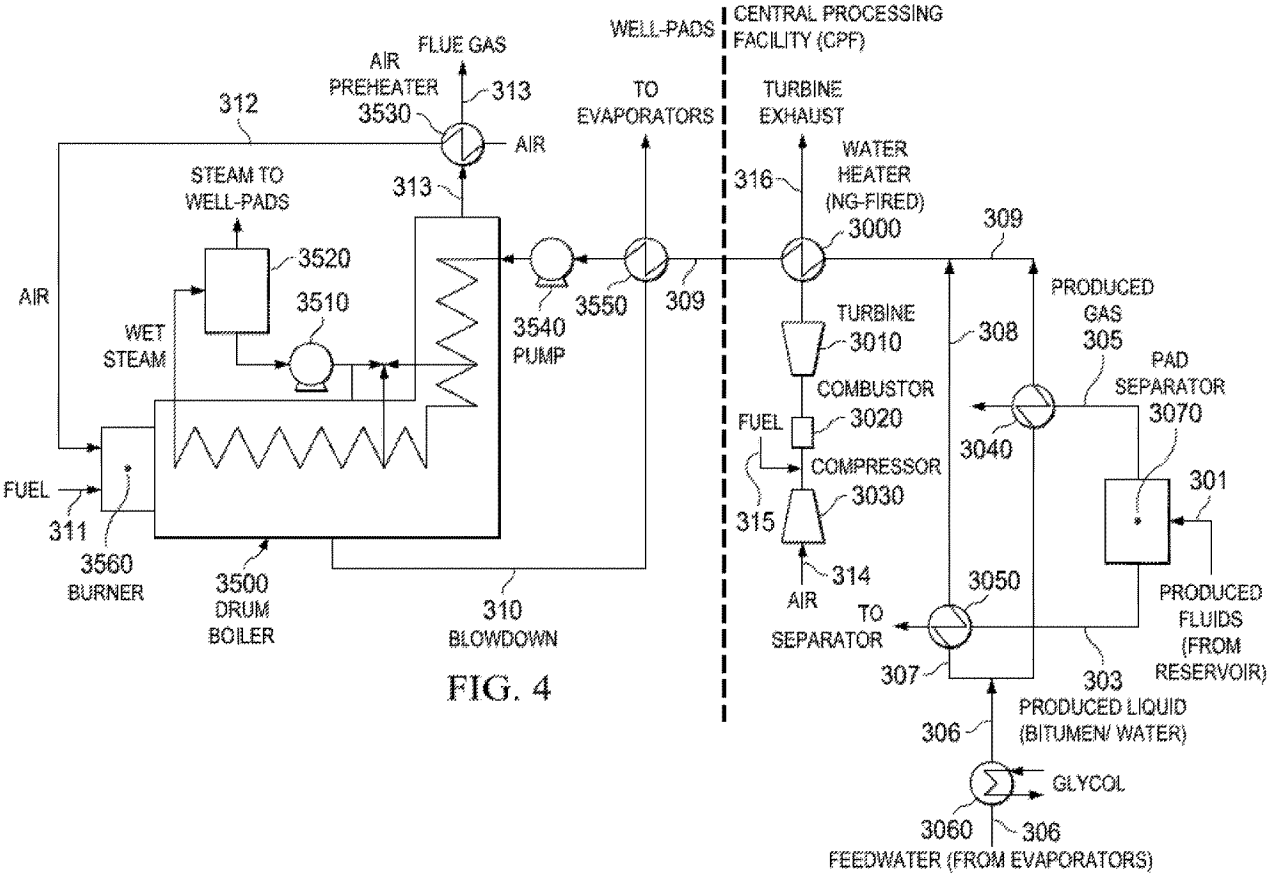
FIG. 4. Another embodiment using preheated well pad steam generator concept, with heat provided by gas turbine exhaust gas.

FIG. 4 shows yet another possible embodiment, wherein a gas turbine 3010 generates heat and electricity (not shown) for use on site, by burning air routed through compressor 3030 in combustor 3020 fed by fuel line 315 and air line 314. The burning fuel rotates the turbine 3010 and the hot gases used to preheat water in heat exchanger 3000, and exit via turbine exhaust line 316. As in FIG. 3, the water entering heat exchanger 3000 can be preheated by a variety of hot fluids readily available at the pad, further improving efficiency. The remainder of FIG. 4 is similar to FIG. 3, having a number of heat exchangers (3040, 3050, 3060, 3530, 3550), pumps (3540, 3510), air (312, 314) and fuel lines (311, 315), feedwater lines (306, 307, 308, 309), separators (3520, 3070), blowdown water line 310, produced gas line 305, produced liquid line 303 and drum boiler 3500 which accepts the remotely preheated water as a boiler feedwater, and uses burner 3560 to produce the hot gas that turns the heated feedwater to steam and is exhausted via line 313.

The invention claimed is:

1. A method of generating steam for use in a well to produce oil, said method comprising:

a) heating a boiler feedwater located at a central processing facility (CPF) to produce heated boiler feedwater (HBFW);

b) transporting said HBFW to a well pad via hot water lines, wherein said HBFW has a subcool of 5-30° C.;

c) feeding said HBFW into a well pad boiler located at said well pad;

d) converting said HBFW to steam in said well pad boiler; and e) injecting said steam into a well located at said well pad to produce oil.

2. The method of claim 1, wherein said pad boiler is a water tube drum boiler.

3. The method of claim 1, wherein said heating step a) is by a gas burning water heater.

4. The method of claim 1, wherein said heating step a) is by a gas burning turbine heater that produces electricity and HBFW.

5. The method of claim 1, wherein said heating step a) is by a once through steam generator (OTSG).

6. The method of claim 1, wherein said heating step a) is preceded by a preheating step to preheat said boiler feedwater.

7. The method of claim 1, wherein said feeding step c) is preceded by a preheating step to preheat said HBFW.

8. The method of claim 1, wherein said heating step a) is preceded by a preheating step to preheat said boiler feedwater and wherein said feeding step c) is preceded by a preheating step to preheat said HBFW.

9. The method of claim 1, wherein said subcool is 10-20° C.

10. A steam generator system for oil production, comprising:

a) a water heater located at a CPF to heat boiler feedwater to HBFW, said HBFW having a subcool of 5-30° C.;

b) a hot water line for transporting said HBFW with a subcool of 5-30° C. from said CPF to a well pad;

c) a steam generator located at said well pad, said steam generator being fed by said hot water line;

d) a steam line for injecting steam into a well at said well pad; and, e) wherein elements a though d are fluidly connected.

11. The steam generator system of claim 10, further comprising a heat exchanger located at said CPF for preheating said boiler feedwater.

12. The steam generator system of claim 10, further comprising a heat exchanger located at said well pad for preheating said HBFW.

13. The steam generator system of claim 10, further comprising a heat exchanger located at said CPF for preheating said boiler feedwater and a heat exchanger located at said well pad for preheating said HBFW.

14. The steam generator system of claim 10, wherein said steam generator is a water tube drum boiler.

15. The steam generator system of claim 10, wherein said water heater is a gas turbine water heater.

16. The steam generator system of claim 10, wherein said water heater is an OTSG.

17. The steam generator system of claim 10, wherein said water heater is a gas fired water heater.

18. The steam generator system of claim 10, wherein said water heater is a natural gas fired water heater.

* * * * *